United States Patent [19]

Czetto et al.

[11] Patent Number: 4,900,038

[45] Date of Patent: Feb. 13, 1990

[54] ARROWED PROJECTILE STRUCTURE

[76] Inventors: Paul Czetto, 163 Cocoa Dr.; David Woods, P.O. Box 1494, both of Tavernier, Fla. 33070

[21] Appl. No.: 164,684

[22] Filed: Mar. 7, 1988

[51] Int. Cl.[4] ..... A63B 65/02; F41B 5/02

[52] U.S. Cl. ..... 273/416; 273/423; 273/72 R

[58] Field of Search ..... 273/416, 420, 421, 422, 273/423, 80 A, 72 R, 72 A; 272/124

[56] References Cited

U.S. PATENT DOCUMENTS 514,420 2/1894 Jacobus ..... 273/72 R 4,489,949 12/1984 Taylor et al. ..... 273/416

OTHER PUBLICATIONS

"Bow and Arrow Hunting", Apr. 1985, p. 13, 273 *416.

*Primary Examiner*—William H. Grieb

*Assistant Examiner*—Valerie Szczepanik

*Attorney, Agent, or Firm*—Larson and Taylor

[57] ABSTRACT

An arrowed projectile comprising an elongated linearly configured body having a hollow interior portion extending along the length thereof and preferably having an arrowed, closed first end and a second oppositely disposed second end which may have fletchings as in typical arrow construction. Kinetic energy transferring members are captivated within the hollow interior portion of the body and movable between a first portion adjacent the rear end upon initial flight of projectile from a projecting device and transferable towards one leading end to a second position of impact so as to cause successive bursts or thrusts occurring as the energy transferring slide member impacts upon the leading end of the body and one another.

13 Claims, 1 Drawing Sheet

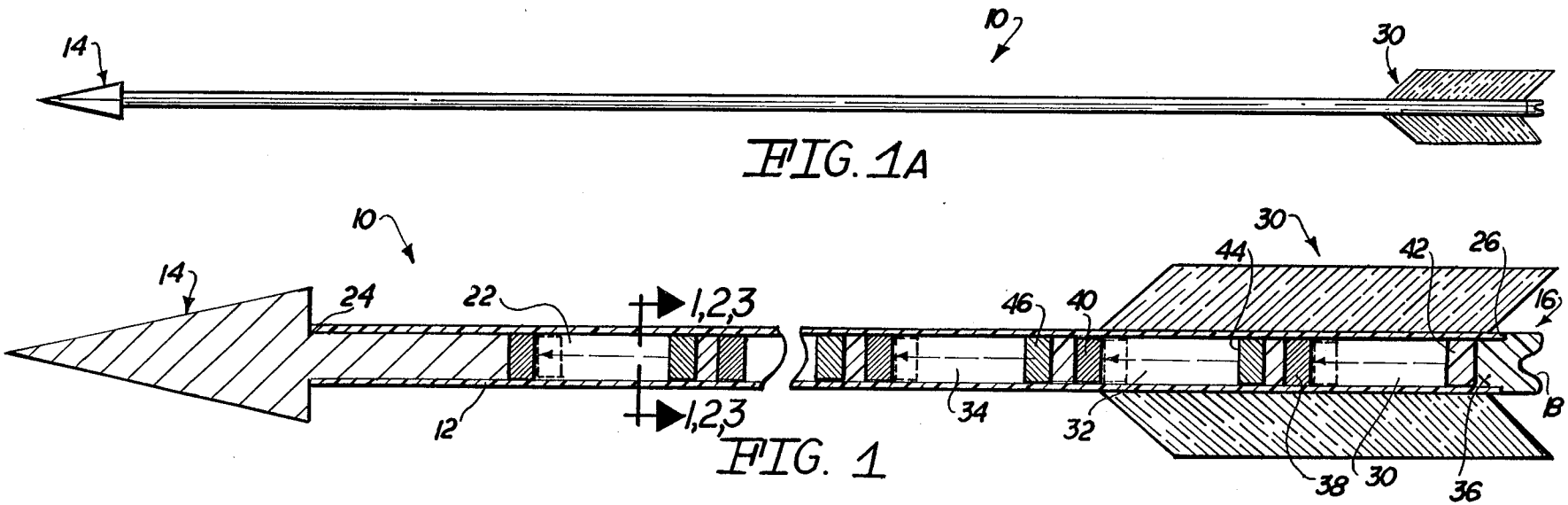
FIG. 1A
FIG. 1
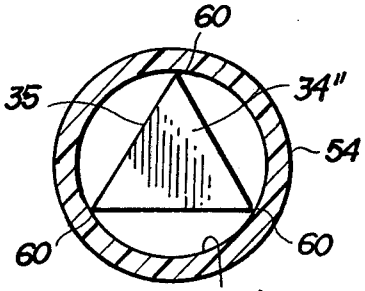
FIG. 4
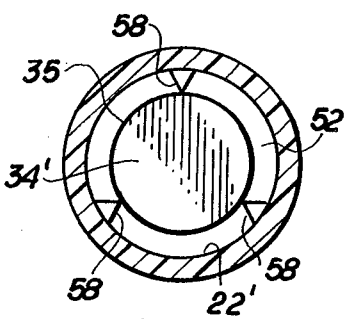
FIG. 3
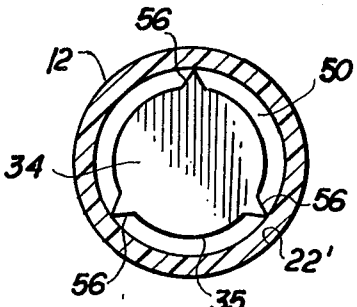
FIG. 2

ARROWED PROJECTILE STRUCTURE

BACKGROUND OF THE INVENTION

1. Field of the Invention

This invention relates to an elongated projectile in the form of an arrow, spear or like pointed projectile having a hollow interior along at least a portion of its length and at least one and preferably a plurality of sliding energy transferring members disposed therein which are cooperatively structured with the body to transfer energy preferably towards the leading end of the body upon impact thereof on an intended target.

2. Description of the Prior Art

Pointed projectiles such as arrows, spears, etc. of course well known in the art and in one form or another consituted some of mans earliest weapons. With regard to arrows of the type launched from hand bows or mechanical bow guns, cross-bows, etc. relatively little advancement has been made in the structural design of such arrows with the possible exception of the material from which said structures are made. Modern manufacturing techniques have of course greatly enhanced the aero-dynamics and the materials utilized to make the arrow structure lighter, stronger, and thereby improve its flight characteristics.

However, for the most part, prior art structures attempting to increase the impact force or penetrating characteristics of such an arrow have relied for the most part on the configuration of the arrow head or point rather than on significant structural changes to the body or the provision of any type of energy transferring means.

Accordingly, there is a need in this industry for an improved structure of a pointed or arrowed projectile having greater impact and penetrating characteristics.

SUMMARY OF THE INVENTION

The present invention is directed towards an arrowed projectile. This term, as used herein may refer to an arrow structure of the type capable of being launched or projected from a hand-bow, cross-bow or like device. Alternately, the structure of the present invention can be incorporated in a "spear" type projectile of the type used in spear guns for underwater hunting or the like. This explanation however is not meant to be limiting to the extent that the structure described in greater detail hereinafter can be incorporated in numerous types of similar projectiles wherein it is desired to increase the penetrating or impact characteristics of such a projectile.

Regardless of the embodiment, the arrowed or pointed projectile comprises an elongated body having a hollow interior portion and therefore defining what may be referred to as a tubular-type elongated shaft. An arrow head may be secured to a leading end thereof wherein the opposite or trailing end thereof is preferably bifurcated, in the conventional manner and may have fletchings formed thereon depending upon the particular embodiment with which the subject invention is used. The hollow interior portion extends along a significant and preferably a major portion of the length of the body and is closed both at the leading end and the trailing end.

Energy transfer means are provided in the form of at least one but preferably a plurality of slide members captivated on the interior of the hollow interior portion between the leading and trailing ends and therefore slidably positionable between a rear-most or trailing position and a forward position. As will be explained in greater detail hereinafter these sliding members may be considered kinetic energy storing members. Sliding members may in fact be weighted to add to their force of impact on the leading end. More specifically, it will be realized that upon impact of the pointed or arrowed end (leading end) of the body with a target, the plurality of sliding members will move forward at such impact transferring their kinetic energy to the leading or arrowed end which has penetrated the target. In a preferred structure, however, when a plurality of such members are utilized, each of the members will successively impact first unto the leading end of the body and than successively on to one another. This will result in a greater penetration of the arrowed end as additional bursts or thrusts are transferred to the arrow at impact instead of one smooth force.

In order to facilitate sliding movement of the one or more weight members or sliding members within the hollow interior portion and along the length thereof, spacer means are provided to create and maintain pockets or spaces between the inner surface of the hollow interior portion and the outer surface of the weight members themselves. Such may be accomplished either by defining the cross-sectional configuration of the sliding members continuously along their lengths so that only the outer projecting extremities of such members slidingly engage the inner surface of the hollow interior portion, such transverse configuration could be a triangle or like multi-cornered or pointed transverse configuration.

A plurality of fins could be fixedly formed on either the outer surface of the weight members themselves or the inner surface of the hollow interior portion as will be explained in greater detail hereinafter.

Retaining means in the form of magnets are also secured to the individual slide member. More specifically, magnetic means of varying force are utilized to hold the slide members in the rearward position adjacent substantially the trailing end of the hollow interior portion. The forward most sliding member will be held in place by a lesser magnetic force than the rearward member. This will result in the forward member being released first upon impact and almost immediately thereafter the second member and succeeding members will be successively released upon the force of impact of the arrowed end of the body striking the target.

It will be recognized by those in the art that it is preferably that the forward half of the arrowed projectile be of a weight of about 60% of the total weight of the arrow. For this reason, the location of the members may be somewhat more forward. For example, the rear insert may actually constitute a plug blocking the rearward portion of the chamber so that the correct weight distribution is provided by the arrowed projectile.

The invention accordingly comprises the features of construction, a combination of elements, an arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which:

FIG. 1A is a side elevational view of an arrow of the type in which the present invention is incorporated.

FIG. 1 is a longitudinal sectional view of the structure of the present invention showing a plurality of weight elements movably mounted on a hollow interior portion thereof.

FIG. 2 is a transverse cross-sectional view of one embodiment of the present invention.

FIG. 3 is a transverse cross-sectional view of yet another embodiment of the present invention.

FIG. 4 is a transverse cross-sectional view of yet another embodiment of the present invention.

Like reference numerals refer to like parts throughout the several views of the drawings.

DETAILED DESCRIPTION OF THE PREFERRED EMBODIMENT

As shown in FIG. 1A and in FIG. 1, an arrow is shown which is generally indicated as 10 and is in the form of an arrowed structure which may resemble the type of arrow structure configuration launched from a hand-bow, cross-bow, or the type mechanical launching device. Alternately, the structure could be representative of a spear or like pointed instrument of the type being launched from a spear gun of the type generally used under water. In either embodiment, the arrow structure 10 comprises an elongated body 12 having a pointed arrowed head or like structure 14 facilitating penetration of the body 12 into a target of varying types. The opposite end generally indicated as 16 may have a bifurcated construction as in 18 to fit a bow string and may include a plurality of fletchings to facilitate aero-dynamic stability of the body 12 during flight. The body further includes a hollow interior portion 22 extending along at least a majority of the length of the body 12 and terminating at a closed first end as at 24 and the aforementioned closed opposite end as at 26.

Energy transfer means is provided in the form of at least one but preferably a plurality of energy transfer weight elements 30, 32 and 34 each having an elongated configuration and each being slidingly movable along the length of the body and within the hollow interior portion 22 independent of one another. Depending upon the size of the arrow and the particular application for which it is intended, the plurality of weight elements 30, 32 and 34 may vary or may be selectively variable within certain preferred ranges.

In addition, a retaining means comprising a first retaining element preferably in the form of a fixed magnet 36 secured to the opposite end generally indicated as 16 and disposed so as to retain within hollow interior portion 22 the adjacent; weight element 30. In addition, the retaining means further includes a plurality of other magnets 38 and 40 secured to the successively positioned weight elements 30 and 34. Further, each of the weight elements includes a magnetically attractable material preferably in the form of a steel or any other like applicable material cap or end-mount 42, 44 and 46 each positioned on a trailing end of each of the weight elements 30, 32 and 34 respectively so as to be retained through magnetic attraction to the correspondingly or cooperatively positioned magnetic element 36 (FIGS. body 12) 38 and 40 respectively.

Accordingly, in operation, each of the weight elements are disposed in end-to-end engaging relation with one another with the trailing-most weight element 30 disposed in a butting and retained engagement with the fixed magnet 36. Upon launching from any given launching device, as set forth above, the plurality of weight elements will be maintained in their immediately adjacent and end-to-end successive relation to one another. However, upon the pointed end 14 striking a target, of any desired type, the sudden impact will cause a release of the corresponding magnetically attractable material end-mounts 42, 44 and 46 from their correspondingly retaining magnets 36, 38 and 40 respectively. This in turn will cause a successive impact as each of the weight elements 34, 32 and 30 successively strike the leading most end 24 and the preceding weight element. For example, upon the arrowed or pointed end 14 of the body 12 striking a target, each of the weight elements 34, 32 and 30 will be successively released from the next adjacent and trailing weight element and from the retaining magnet 36 at the opposite end 16. This successive release may be due in part to the magnets 36, 38 and 40 being structured to have a progressively lesser magnetic strength. Accordingly, since magnet 40 has the least magnetic strength, the weight element 34 will be released first. Magnet 38 having the next least magnetic strength, the next succeeding weight element 32 will subsequently be released. Each of the weight elements 34, 32 and 30 will then successively impact onto the closed end 24 or the next preceding weight element. For example, weight element 34 will first impact onto the closed end 24. The second weight element 32 will next impact onto the first weight element 34 and finally the last or trailing-most weight element 30 will impact onto the next preceding weight element 32. These successive impacts will have the effect of transferring kinetic energy to the pointed end 14 thereby greatly improving its penetrating and impacting characteristics.

In order to facilitate travel of the weight element along the length of the hollow interior portion 22, a space as at 50, 52 and 54 is maintained between the outer surface of each of the weight elements 34, 34' and 34" wherein each of the immediately preceding reference numerals are meant to indicate different structural embodiments which one or all or the weight elements may assume. In the embodiment of FIG. 2, the weight element 34 has spacer means in the form of a plurality of radially outwardly-extending fins 56 integrally or fixedly attached thereto in spaced apart relation to one another. The outer surface 35 of the weight element 34 is therefore maintained in spaced relation to the inner surface 22' of the body 12 so that the spacing or spaces 50 may be maintained thereby facilitating sliding movement and the elimination of any trapped air which would prevent or hinder the sliding axial movement of each of the weight elements within the hollow interior portion 22.

In the embodiment of FIG. 3, the spacer means includes a plurality of inwardly directed fins 58 integrally or fixedly formed on the inner surface 22' of the hollow interior portion and extending radially inward so as to engage at the outer extremity therof the outer surface 35 of the weight element 34'.

In yet another embodiment shown in FIG. 4, the weight element 34" includes a substantially triangular transverse sectional configuration such that the outer extremities of each of the eight axis of the triangular configuration as at 60 defines spacer means which maintains the majority of the outer surface 35 out of contact with the inner surface 22' of the hollow interior portion 22. In this manner, the plurality of spaces as at 54 may be maintained to facilitate the aforementioned axial movement of the weight elements.

Now that the invention has been described,

What is claimed is:

1. An arrow device adapted to be propelled from a bow or like propelling device, said arrow device comprising:

an elongate, substantially straight body member including a point at one end therof; said body member including an inner wall which defines a hollow interior portion extending along at least a majority of the length of the body member between said one end and the opposite end of said body member;

at least one energy transfer member disposed within said hollow interior portion of said body member so as to be slidably displaceable therealong between a rest position and an impact position;

retaining means, mounted at least partially within said body member, for retaining said energy transfer member in the rest position thereof when said arrow device is propelled by the propelling device and for releasing said energy transfer member upon impact of the point of the arrow with a target so that energy transfer member is slidably displaced along the hollow interior portion of the body member to the impact position thereof thereby creating a further impact against the target and thus increasing the penetration of the arrow into the target;

said energy transfer member comprising an elongate weight element including at least one longitudinal side wall portion substantially spaced from said inner wall of said body member so as to define an air passage along the length of the weight element to thereby prevent trapped air from hindering movement of said weight element, said element including spacer means extending radially outward from an outer surface thereof for supporting said element in spaced relation to the inner wall of said body member which defines said hollow interior portion, said spacer means comprising a plurality of elongated angularly spaced fins extending along the length of said element for slidably engaging said inner wall.

2. A device as in claim 1 wherein said retaining means comprises a magnet secured to said body member, and at least a portion of said energy transfer member being formed of a magnetic attractable material.

3. A device as in claim 2 wherein said portion of said energy transfer member comprises an end piece of magnetically attractable material secured to one end of said energy transfer member.

4. A device as in claim 3 wherein said magnet is fixedly secured to said body member at said opposite end thereof, said energy transfer member being slidingly displaced along substantially the entire length of said hollow interior portion upon disengagement thereof with said magnet into abutting engagement with a first end of said hollow interior portion located substantially adjacent said one end of said body member.

5. A device as in claim 4, wherein said element includes said magnetically attractable material formed at one end thereof nearest said magnet.

6. A device as in claim 5 wherein said retaining means further comprises a secondary magnet secured to an opposite end of said element relative to said one end thereof, said secondary magnet disposed in adjacent, attracting relation with magnetically attractable material secured to a next preceding element.

7. A device as in claim 4 wherein said at least one energy transfer member comprises a plurality of said elements each having a first end formed of a magnetically attractable material, each element of said plurality of said elements except a first one having a secondary magnet formed on a second end thereof.

8. A device as in claim 7 wherein a last one of said plurality of weight elements is removably attachable to said magnet secured to said body member and removably attachable to a next preceding element.

9. A device as in claim 8 wherein each of said plurality of weight elements are interconnected to one another.

10. An arrow device adapted to be propelled from a bow or like propelling device, said arrow device comprising:

an elongate, substantially straight body member including a point at one end thereof; said body member including a hollow interior portion extending along at least a majority of the length of the body member between said one end and the opposite end of said body member;

a plurality of energy transfer members each disposed within said hollow interior portion of said body member so as to be slidably displaceable therealong between a rest position and an impact position;

retaining means, mounted at least partially within said body member, for retaining said energy transfer member in the rest position thereof when said arrow device is propelled by the propelling device and for releasing said energy transfer member upon impact of the point of the arrow with a target so that energy transfer member is slidably displaced along the hollow interior portion of the body member to the impact position thereof thereby creating a further impact against the target and thus increasing the penetration of the arrow into the target;

said energy transfer members comprising elongated weight elements each independently movable relative to one another along the length of said hollow interior portion, said retaining means including a first magnet fixedly secured to said body at said opposite end thereof and a plurality of further magnets equal in number to the number of weight elements, each of said plurality of further magnets being fixedly secured to a leading end of a corresponding weight element, each of said plurality of weight elements including one end thereof formed of a magnetically attractable material and disposed in engagement with the magnet on the next adjacent succeeding weight element, said first magnet being of greater magnetic strength than the other magnets of said plurality of magnets.

11. A structure as in claim 10 wherein each of said other magnets on said weight element are of progressively lesser strength.

12. An arrow device adapted to be propelled from a bow or like propelling device, said arrow device comprising:

an elongate, substantially straight body member including a point at one end thereof; said body member including an inner wall which defines a hollow interior portion extending along at least a majority of the length of the body member between said one end and the opposite end of said body member;

at least one energy transfer member disposed within said hollow interior portion of said body member so as to be slidably displaceable therealong between a rest position and an impact position;

retaining means, mounted at least partially within said body member, for retaining said energy transfer member in the rest position thereof when said arrow device is propelled by the propelling device and for releasing said energy transfer member upon impact of the point of the arrow with a target so that energy transfer member is slidably displaced along the hollow interior portion of the body member to the impact position thereof thereby creating a further impact against the target and thus increasing the penetration of the arrow into the target;

said energy transfer member comprising an elongate weight element including at least one longitudinal side wall portion substantially spaced from said inner wall of said body member so as to define an air passage along the length of the weight element to thereby prevent trapped air from hindering movement of said weight element, said device further comprising spacer means including a plurality of elongated angularly spaced fin elements extending along the length of said element for slidably engaging said inner wall.

13. An arrow device adapted to be propelled from a bow or like propelling device, said arrow device comprising:

an elongate, substantially straight body member including a point at one end thereof; said body member including an inner wall which defines a hollow interior portion extending along at least a majority of the length of the body member between said one end and the opposite end of said body member;

at least one energy transfer member disposed within said hollow interior portion of said body member so as to be slidably displaceable therealong between a rest position and an impact position;

retaining means, mounted at least partially within said body member, for retaining said energy transfer member in the rest position thereof when said arrow device is propelled by the propelling device and for releasing said energy transfer member upon impact of the point of the arrow with a target so that energy transfer member is slidably displaced along the hollow interior portion of the body member to the impact position thereof thereby creating a further impact against the target and thus increasing the penetration of the arrow into the target; said energy transfer member comprising an elongate weight element including at least one longitudinal side wall portion substantially spaced from said inner wall of said body member so as to define an air passage along the length of the weight element to thereby prevent trapped air from hindering movement of said weight element;

said weight element being of a triangular cross-sectional shape over substantially the entire length thereof, each corner of said element of triangular shape being disposed for sliding engagement relative to said inner wall.

* * * * *